US006930656B2

(12) United States Patent
He

(10) Patent No.: US 6,930,656 B2
(45) Date of Patent: Aug. 16, 2005

(54) METHOD OF DISPLAYING MULTIPLE IMAGES FORMED FROM PIXELS

(76) Inventor: Lin-Qing He, Room 104, No. 120, Lane 380, South Yuping Rode, Shanghai (CN)

( * ) Notice: Subject to any disclaimer, the term of this patent is extended or adjusted under 35 U.S.C. 154(b) by 298 days.

(21) Appl. No.: 10/318,645

(22) Filed: Dec. 16, 2002

(65) Prior Publication Data

US 2004/0012543 A1 Jan. 22, 2004

Related U.S. Application Data

(60) Provisional application No. 60/391,287, filed on Jun. 24, 2002.

(51) Int. Cl.[7] ..... G09G 3/00

(52) U.S. Cl. ..... 345/30; 345/55; 715/765

(58) Field of Search ..... 345/30, 55, 56, 345/59; 715/790, 764–766, 717, 792

(56) References Cited

U.S. PATENT DOCUMENTS 6,724,403 B1 * 4/2004 Santoro et al. ..... 715/765

* cited by examiner

*Primary Examiner*—Regina Liang
*Assistant Examiner*—Jennifer T. Nguyen
(74) *Attorney, Agent, or Firm*—Raymond Y. Chan; David and Raymond

(57) ABSTRACT

A method of displaying multiple images formed from pixels, including the steps of providing a plurality of raw images, extracting a utility image zone for each of the raw images, and dividing the utility image zone of each of the raw images into a plurality of image pixels, for each of the image pixels of each of the utility image zones establishing a plurality of pixel arrays arranged to distribute in a predetermined orientation, providing a raw canvas, dividing the canvas into a plurality of canvas pixels, and for each of the canvas pixels, establishing a plurality of canvas pixel matrixes arranged with respect to the predetermined orientation of the pixel arrays, adjusting sizes of the image pixels of the utility image zones equal to sizes of the canvas pixels of the raw canvas respectively, superimposing the image pixel arrays onto the canvas pixel arrays respectively in a predetermined order to form a multiple image canvas, providing a plurality of filtering grids in such a manner that the filtering grids are capable of sliding along the multiple image canvas so as to selectively block and display the image pixels, and providing illumination to the multiple image canvas for display advertising images.

12 Claims, 7 Drawing Sheets

METHOD OF DISPLAYING MULTIPLE IMAGES FORMED FROM PIXELS

CROSS REFERENCE OF RELATED APPLICATION

This is a regular application of a provisional application, application No. 60/391,287, filed Jun. 24, 2002.

BACKGROUND OF THE PRESENT INVENTION

1. Field of Invention

The present invention relates to a displaying method, and more particularly to a dot matrix displaying method used in an advertisement lamp box for displaying multi advertisement image in dot matrix form.

2. Description of Related Arts

Advertisement lamp boxes are widely used for promoting one or several kinds of products. They are usually erected or setup outside a company in which it owns the advertisement lamp box, or at a people or automobiles intensive location such as on a freeway or outside a shopping mall.

Conventional advertising method using the above-mentioned conventional lamp box usually comprises the steps of providing a printing medium, such as a fabric-made or paper-made advertising poster having a plurality of advertising graphics or text printed thereon, mounting the poster inside the lamp box in such a manner that it is being stretched and capable of rotating inside the lamp box so that different advertising images or graphics can be shown by mechanically rotating the poster. Depending on the operator's preference and the marketing requirement, the poster can be rotated continuously or periodically over a period of time.

Such conventional method of displaying advertising images or graphics possesses several drawbacks. First, the change of advertising image for the above advertisement lamp box can only be achieved by mechanically rotating the advertising poster from one position to another position. This makes the changing process slow and inflexible. In this information era, this method of displaying advertisement is indisputably obsolete and ineffective.

On the other hand, it is no doubt that the effect of a particular advertisement for a particular product will severely affect the image and therefore the sales of that particular product. This is especially true with respect to the visual effect of an advertisement. With the conventional advertising lamp box as mentioned above, the visual effect of the poster mounted and stretched therein will then be limited.

Because of the foregoing reasons, and with the rapid development of sophisticated information technology, electronic monitors or screens have been developed to display different advertisement. These electronic monitors or screens replace the conventional advertising lamp box and display different advertisements electronically. The shift from one advertisement to another is by means of electronic method, and the sequence of which is usually determined by a computer program or an electronic control algorithm. Though these kinds of pure electronic advertising method allow dynamic and sophisticated visual effect, and that the change of advertisement is fast virtually instant, the cost of producing it is unavoidably high. For big corporations, the cost of these kinds of advertising method can be justified easily because of their relatively big market and higher profit margin, however, for small and medium enterprises (SMEs), they may not be able to withstand such a high advertising cost for their products.

SUMMARY OF THE PRESENT INVENTION

A main object of the present invention is to provide a method of displaying multiple images formed from pixels which has short image changing time so as to produce a variety of visual effects to the observers of the dot matrix images.

Another object of the present invention is to provide a method of displaying multiple images formed from pixels for advertising purpose, wherein each of the images displayed is clear and has high resolution, so as to maximize advertising effect.

Another object of the present invention is to provide a method of displaying multiple images formed from pixels for advertising purpose which is capable of producing high quality and flexible animated display of the images without involving expensive computing technology.

Another object of the present invention is to produce a method of displaying multiple images formed from pixels which does not require sophisticated and expensive technology so as to minimize the manufacturing and operating of the displaying method.

Thus, in order to accomplish the above objects, the present invention provides a method of displaying multiple images formed from pixels, comprising the steps of:

(a) providing a plurality of raw images;

(b) extracting a utility image zone for each of said raw images, and dividing said utility image zone of each of said raw images into a plurality of image pixels;

(c) for each of said image pixels of each of said utility image zones, establishing a plurality of pixel arrays arranged to distribute in a predetermined orientation;

(d) providing a raw canvas 20, dividing said canvas into a plurality of canvas pixels, and for each of said canvas pixels, establishing a plurality of canvas pixel matrixes arranged with respect to said predetermined orientation of said pixel arrays;

(e) adjusting sizes of said image pixels of said utility image zones equal to sizes of said canvas pixels of said raw canvas 20 respectively;

(f) superimposing said image pixel arrays onto said canvas pixel arrays respectively in a predetermined order to form a multiple image canvas;

(g) providing a plurality of filtering grids 60, comprising a displaying grid and a blocking grid, positioned and supported on top on said multiple image canvas in such a manner that said filtering grids 60 are capable of sliding along said multiple image canvas so as to selectively block and display said image pixels; and (h) providing illumination to said multiple image canvas.

DETAILED DESCRIPTION OF THE PREFERRED EMBODIMENT

The present invention involves a method of displaying multiple images formed from pixels. Referring to FIGS. 1 to 3, 13 of the drawings, three example raw images A1, A2, A3 formed from pixels and ready to display according to a first preferred embodiment of the present invention is illustrated. As the first preferred embodiment, the method of the present invention is primarily used for advertising purpose. According to the first preferred embodiment, the method of displaying multiple images formed from pixels comprises the steps of:

(a) providing a plurality of raw images;

(b) extracting a utility image zone for each of the raw images, and dividing the utility image zone of each of the raw images into a plurality of image pixels;

(c) for each of the image pixels of each of the utility image zones, establishing a plurality of pixel arrays arranged to distribute in a predetermined orientation;

(d) providing a raw canvas 20 20, dividing the canvas into a plurality of canvas pixels, and for each of the canvas pixels, establishing a plurality of canvas pixel matrixes arranged with respect to the predetermined orientation of the pixel arrays;

(e) adjusting sizes of the image pixels of the utility image zones equal to sizes of the canvas pixels of the raw canvas 20 respectively;

(f) superimposing the image pixel arrays onto the canvas pixel arrays respectively in a predetermined order to form a multiple image canvas;

(g) providing a plurality of filtering grids 60, comprising a displaying grid and a blocking grid, positioned and supported on top on the multiple image canvas in such a manner that the filtering grids 60 are capable of sliding along the multiple image canvas so as to selectively block and display the image pixels; and (h) providing illumination to the multiple image canvas.

Figure 1:
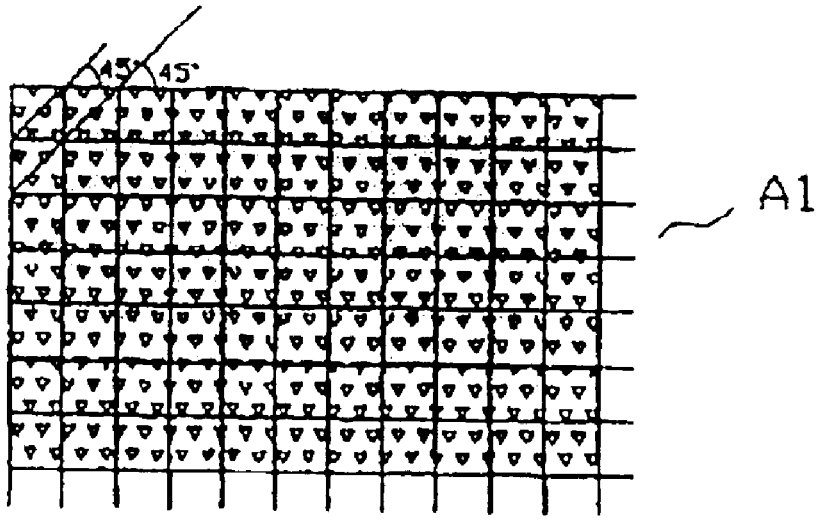
FIG. 1 is a schematic diagram of a first raw image according to a first preferred embodiment of the present invention.
Figure 2:
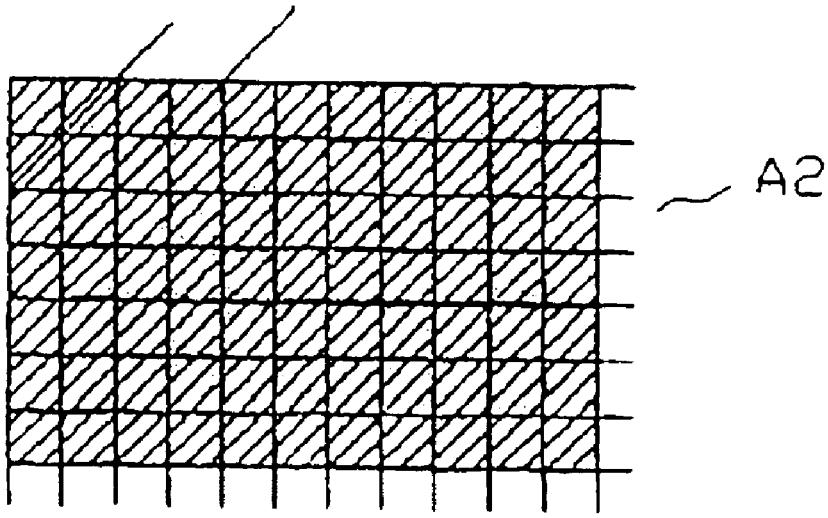
FIG. 2 is a schematic diagram of a second raw image according to the above first preferred embodiment of the present invention.
Figure 3:
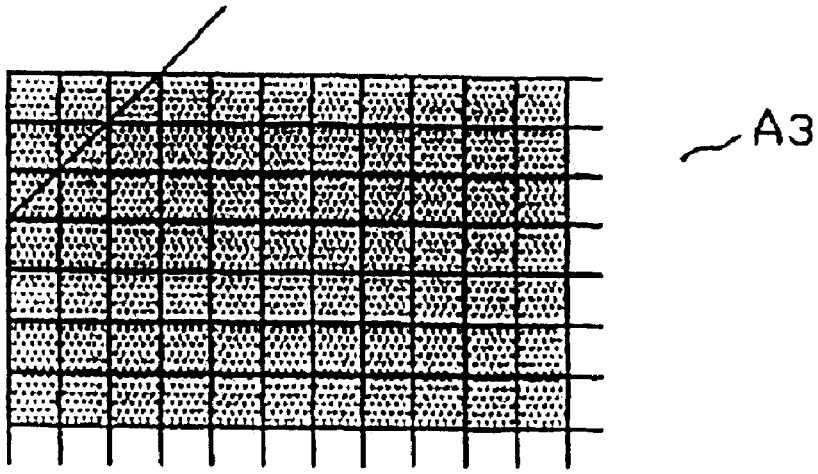
FIG. 3 is a schematic diagram of a third raw image according to the above first preferred embodiment of the present invention.

According to the first preferred embodiment of the present invention, two raw images A1, A2, as shown in FIGS. 1 to 2 of the drawings, are to be shown for advertising purpose. For each of the images A1, A2, two utility image zones are taken at predetermined positions on the images A1, A2 respectively. Each of the utility image zones is divided into a plurality of square image pixels wherein a plurality of pixel arrays are established and arranged in an orientation of 45 degrees with respect to horizontal.

In step (b), the utility image zone is decided and extracted according to actual scenario. It can be a portion of the raw image, or it can be taken as the whole raw image to be displayed. It is important to remark that, the area of each of the utility image zone for the two images A1, A2 need not be the same, though preferable because of convenient implementation of the method in practice. Furthermore, the number of pixels divided for the raw images A1, A2 and the raw canvas 20 are preferably kept equal also because of convenient operation and implementation.

In step (d) and step (e), the raw canvas 20 is divided by a plurality of square canvas pixels, wherein a plurality of canvas pixel arrays are established for each of the square canvas pixels in an orientation of 45 degrees. According to the first preferred embodiment, the area of each of the square canvas pixels is substantially about 1 $mm^2$, meaning that each of the image pixels has to be adjusted, if necessary, by either reducing or enlarging, to have an area of substantially 1 $mm^2$ so as to fit the image pixels with the canvas pixels.

Figure 4:
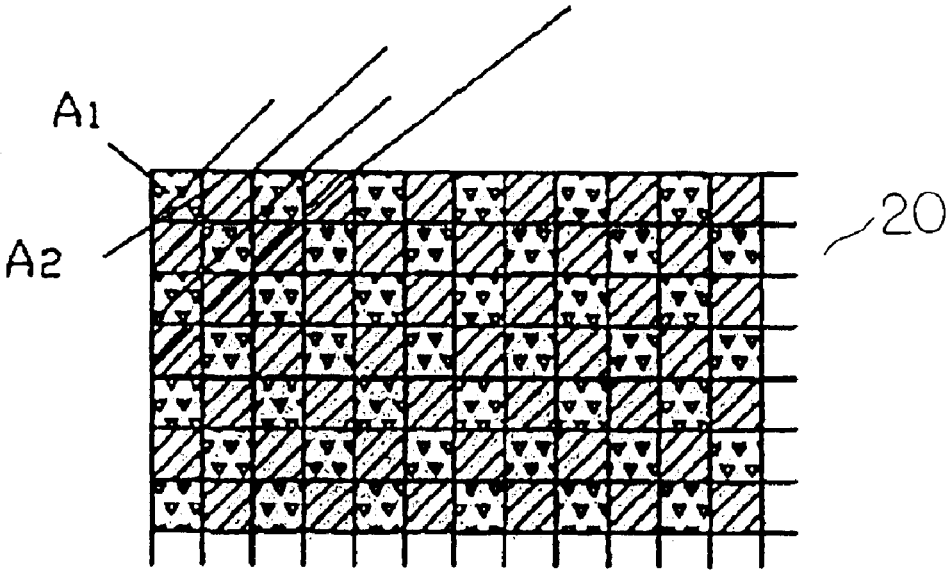
FIG. 4 is a schematic diagram of a canvas according to the above first preferred embodiment of the present invention, illustrating that the canvas is superimposed by image pixels of two raw images.

In step (f), the image pixels arrays of each of the image pixels are taken and superimposed onto the canvas pixel arrays of the respective and equal sized canvas pixels of the raw canvas 20 to form a multiple image canvas, as shown in FIG. 4 of the drawings. It is worth mentioning that the multiple image canvas after step (f) according to the first preferred embodiment should contain two images A1, A2 superimposed on the raw canvas 20 in the forms of their respective image pixel arrays.

Preferably, after step (f) and before step (g), the displaying method of the present invention further comprises a step of implementing a pixel graphics of the multiple images canvas onto a tangible medium such as films, slides, posters etc. for use in an advertising lamp box or for further manipulation of the graphics formed on the multiple image canvas.

It is also worth mentioning that the image pixel arrays and the canvas pixel arrays are not necessarily arranged in 45 degrees. Accordingly, a user of the present invention does not necessary to strictly follow the above-mentioned preferred embodiment as to extract the image pixel arrays and the canvas pixel arrays in accordance with the 45 degrees orientation, as long as the spirit of the displaying method of the present invention is followed.

Figure 5:
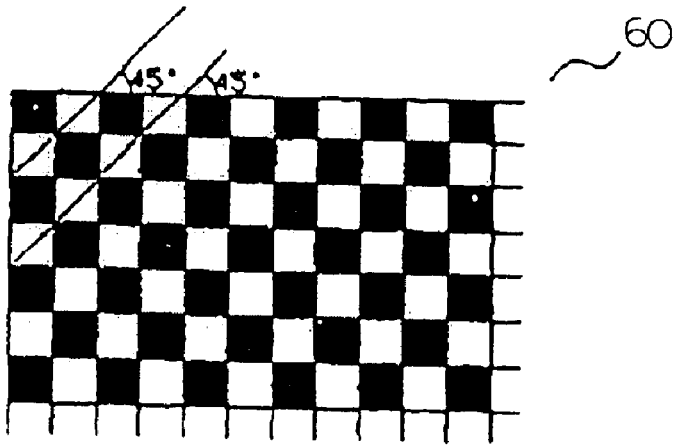
FIG. 5 is a schematic diagram of a filtering grid according to the above first preferred embodiment of the present invention, illustrating that the filtering grid covers the first raw images on the multiple images canvas.
Figure 6:
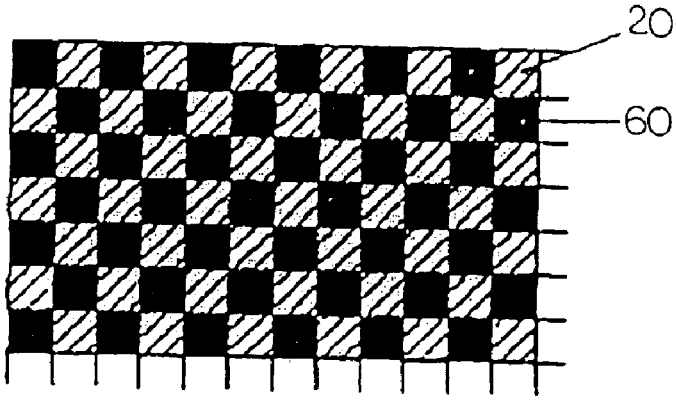
FIG. 6 is a schematic diagram of a filtering grid according to the above first preferred embodiment of the present invention, illustrating that the filtering grid covers the second raw images on the multiple images canvas.

According to the first preferred embodiment, in step (g), the filtering grids 60 comprises a plurality of displaying grids each has the same shape and area as each of the canvas pixels. However, the displaying grids are orientated such that they are in 45 degrees with horizontal. In other words, the displaying grids have the same orientation as the canvas pixel arrays. Furthermore, the distribution of the displaying grids on the multiple image canvas is that the displaying grids are provided on a predetermined interval wherein the predetermined interval is defined as the multiples of the number of raw images minus one. That is, according to the first preferred embodiment wherein the number of raw images are two, the interval between each two displaying grids is one (two minus one) canvas pixel, as shown in FIGS. 5 to 6 of the drawings. In other words, the displaying grids are provided on every other canvas pixels.

On the other hand, the filtering grids 60 further comprises a plurality of blocking grids provided in the middle of each two displaying grids. Of course, the displaying grids are made such that light is capable of passing therethrough, while the blocking grids, as the name implies, are made such that light is incapable of passing therethrough. Note that, depending on the user's preference, the filtering grids 60 can be implemented onto a tangible and printable medium such as films, slides, as well as plastic sheets for convenient use and storage.

FIG. 6 illustrates one example of the above-mentioned displaying method. The filtering grids 60 is slidably moved such that the displaying grids are slid to cover the pixels arrays of the first raw image A1, while the blocking grids are slid to cover the pixels arrays of the second raw image A2. Then, after step (h), the pixel arrays of the first raw image A1 is shown with the pixels arrays of the second raw image A2 blocked. In other words, the user of the displaying method of the present invention can only view the pixel arrays of the first raw image A1.

Note that in step (h), the illuminating effect can be achieved by employing a regular advertising lamp box. Accordingly, the canvas and the driving device can also be received inside the advertising lamp box for convenient operation and storage.

Figure 7:
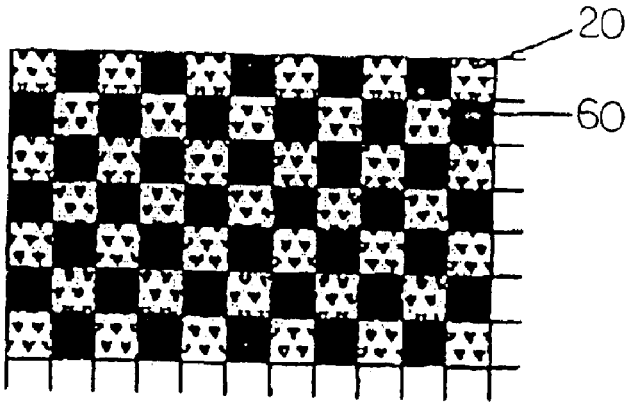
FIG. 7 is a schematic diagram of the filtering gird slidably moved by one pixel according to the above first preferred embodiment of the present invention.
Figure 8:
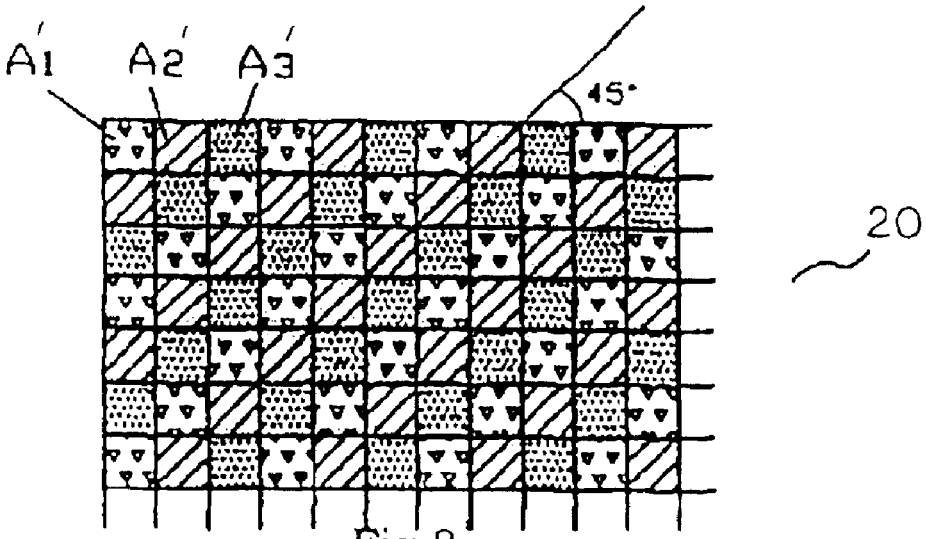
FIG. 8 is a schematic diagram of the canvas according to an alternative mode of the above first preferred embodiment of the present invention.
Figure 9:
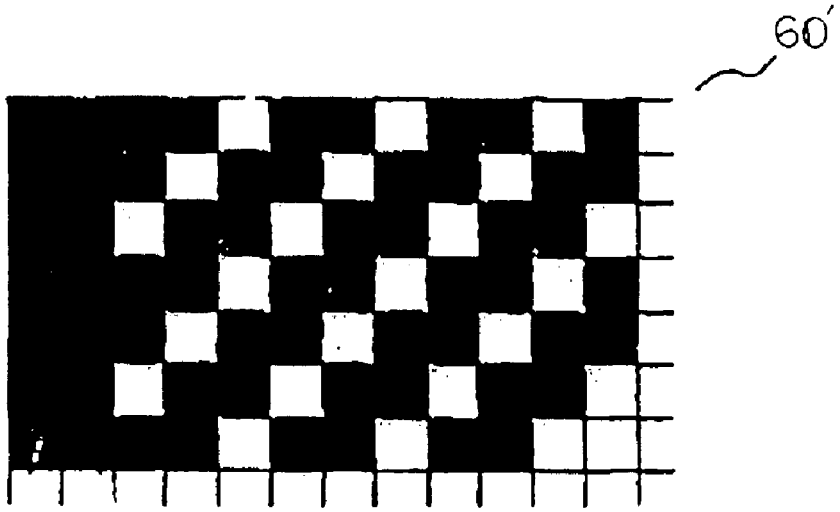
FIG. 9 is a schematic diagram of the filtering grids according to an alternative mode of the above first preferred embodiment of the present invention.
Figure 10:
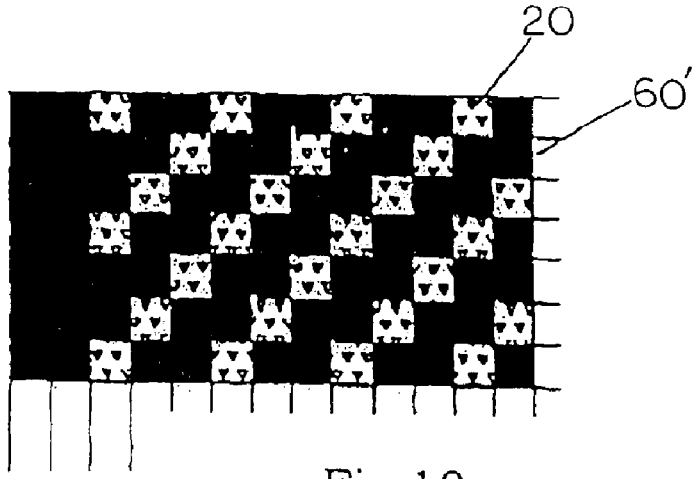
FIG. 10 is a schematic diagram of the canvas according to an alternative mode of the above first preferred embodiment of the present invention, illustrating that the filtering grids are slidably moved by one pixel.
Figure 11:
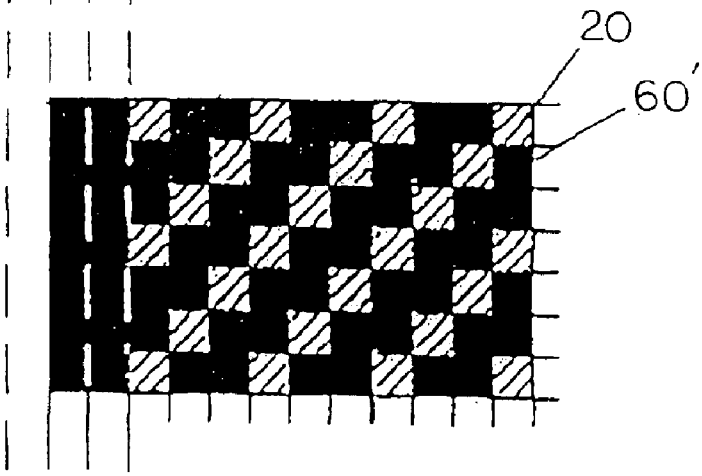
FIG. 11 is a schematic diagram of the canvas according to an alternative mode of the above first preferred embodiment of the present invention, illustrating that the filtering grids are slidably moved by two pixels.
Figure 12:
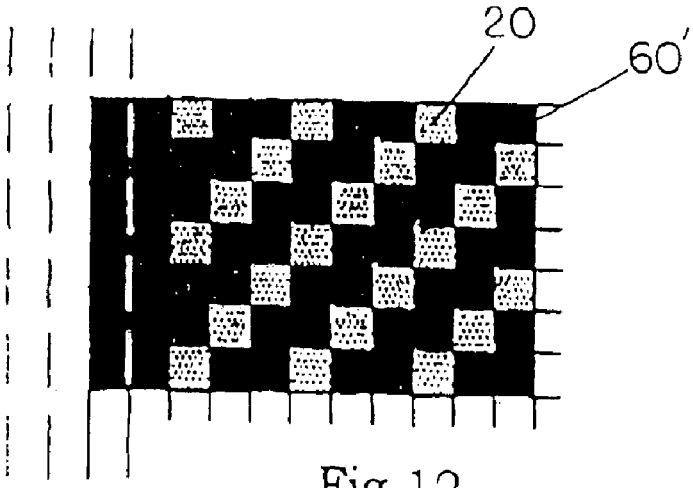
FIG. 12 is a schematic diagram of the canvas according to an alternative mode of the above first preferred embodiment of the present invention, illustrating that the filtering grids are slidably moved by three pixels.

As shown in FIG. 7 of the drawings, the filtering grids 60 are moved by one interval so as to show the pixels arrays of the second raw images A2. When the filtering grids 60 are moved by one interval, the displaying grids are then move to cover the pixel arrays of the second raw image A2, whereas the blocking grids are move to cover the pixel arrays of the first raw image A1. Because of the fact that the area of each of the canvas pixels should be less than 1 $mm^2$, the time of moving a particular filtering grid from one pixel to another can be expected to be very short. As an illustration, the time for the filtering grids 60 to slide between the first and the second pixel arrays is embodied as 0.1 to 0.8 second. In other words, according to the displaying method of the present invention, the time for changing from one image to another is substantially about 0.1 to 0.8 seconds. Since the changing time from one image to another is extremely short, the content of the advertising images A1, A2 can be adjusted to cooperate with the changing mechanism so as to produce impressive visual effects to those watching the advertising images A1, A2. In particular, one can produce a series of raw images A1, A2 and display them continuously so as to produce an animated visual effect to the advertisement's watchers.

Figure 13:
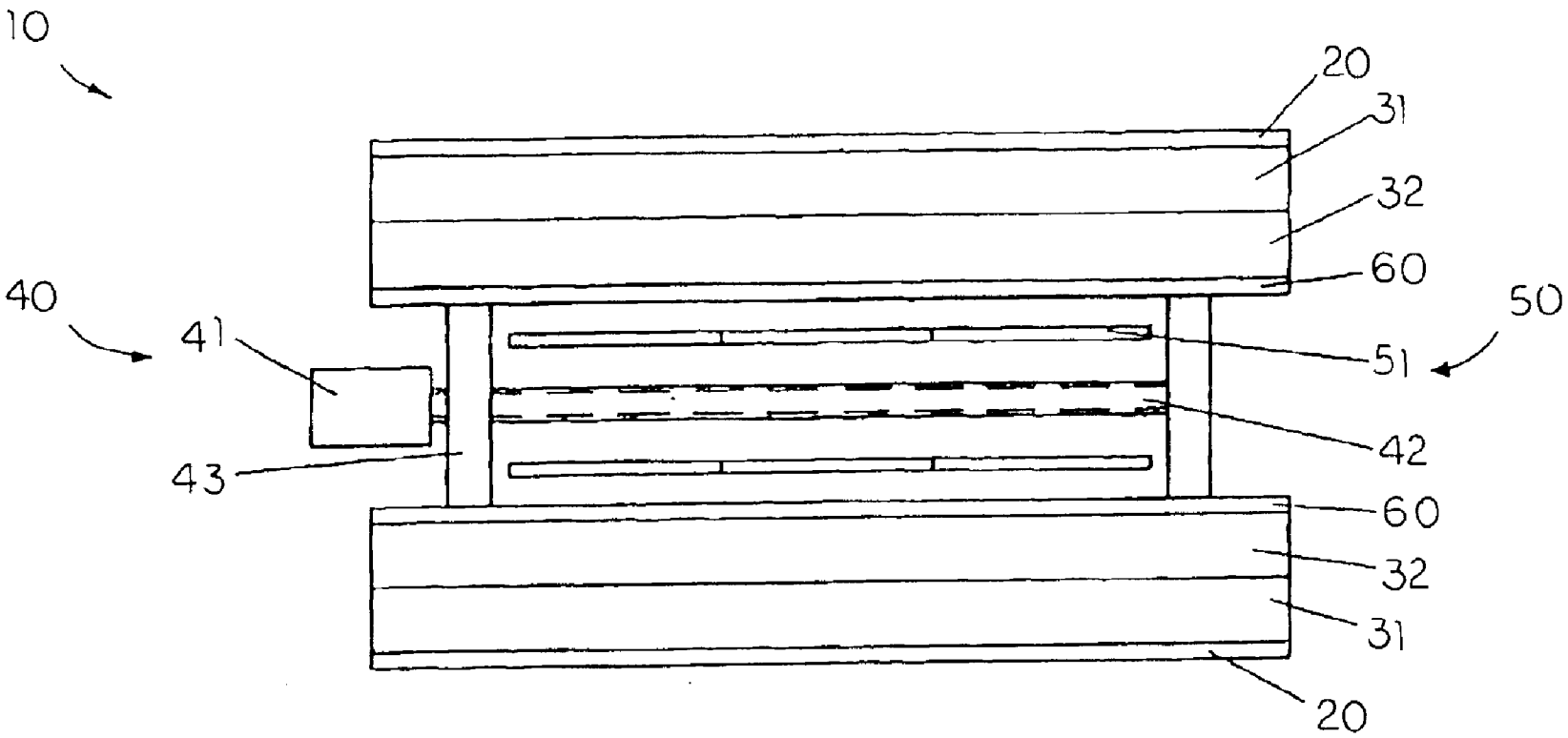
FIG. 13 is a schematic diagram of the driving device according to the above first preferred embodiment of the present invention.

Referring to FIG. 13 of the drawings, a multiple images displaying system 10 that employs the displaying method according to the first preferred embodiment of the present invention is illustrated. The multiple displaying system 10 comprises two canvases 20, two pairs of supporting members 31, 32, a driving device 40, an illuminating device 50, and a plurality of filtering grids 60.

Each pair of supporting members 31 (32) are attached on the canvases 20 and the filtering grids 60 respectively in a side-by-side manner wherein each of the supporting members 31, 32 are made transparent so that in the presence of illumination, the canvas 20 can be viewed through the supporting members 31, 32.

The driving device 40 comprises a driving motor 41, a driving shaft 42 outwardly extended from the driving motor 41 at a position between the two pairs of supporting members 31, 32, and a pair of connecting members 43 operatively connected to the driving shaft 42 and the filtering grids 60 in such a manner that when the driving motor 41 drives the driving shaft 42 to rotate, the pair of connecting members 43 will drive the filtering grids 60 to slide along the supporting members 31, 32 so as to selectively cover the canvas pixel arrays for displaying a desirable image and blocking all other undesirable images. The illuminating device 50 comprises a pair of illuminating units 51 supported at a position between the driving shaft 42 and the two pairs of connecting members 31, 32 respectively for providing illuminating to the canvases 20 through the filtering grids 60, so as to selectively display desirable advertising images.

Referring to FIGS. 8 to 12 of the drawings, the canvas 20 and the filtering grids 60 of a first alternative mode of the displaying method according to the above-mentioned first preferred embodiment of the present invention is illustrated. According to the first alternative mode, the displaying method of the present invention is used to display three advertising images A1', A2', A3'. The displaying method is similar to that of the first preferred embodiment except that the interval of each of the displaying grids is two pixels.

The filtering grids 60' are arranged to slidably move in an interval of one pixel. In other words, the images A1', A2', A3' can be consecutively displayed by slidably moving the filtering grids 60'. It is worth stressing that according to the displaying system 10 a maximum of six images according to the first alternative mode of the present invention can be displayed, so as to enhance the flexibility of the displaying method and increase the advertisement's combinations result from increased advertisements' raw images.

In order to further enhance the quality of the images shown, a plurality of sealing grid rows are formed at and integrally extended from two outside sides of the filtering grids for blocking any light leaking from side edges portions of the outmost filtering grids. According to the first alternative mode, the exact number of sealing grids rows are the number of images minus one, i.e. two in this case.

Figure 14:
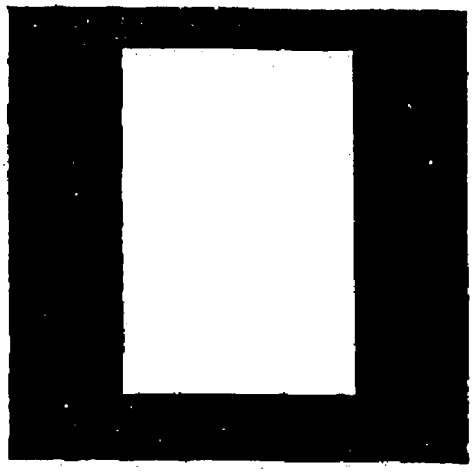
FIG. 14 is a first schematic diagram of the filtering grids according to a second alternative mode of the above first preferred embodiment of the present invention.
Figure 15:
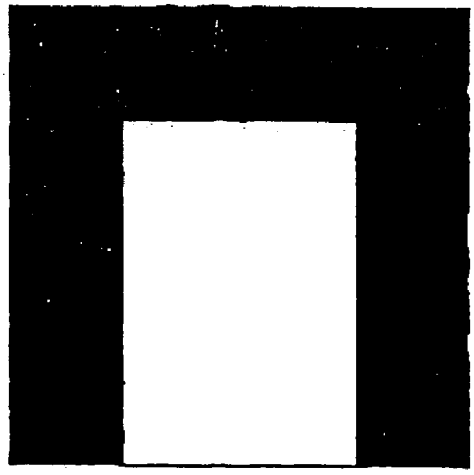
FIG. 15 is a second schematic diagram of the filtering grids according to the above second alternative mode of the above first preferred embodiment of the present invention.
Figure 16:
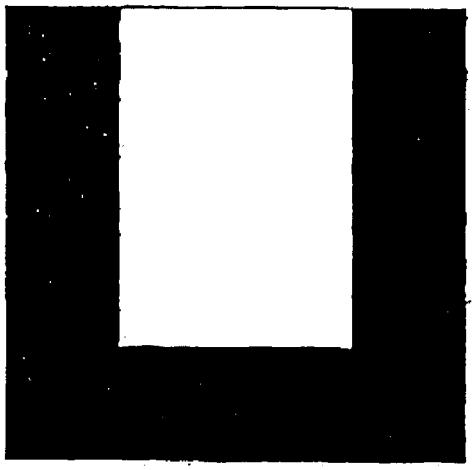
FIG. 16 is a third schematic diagram of the filtering grids according to the above second alternative mode of the above first preferred embodiment of the present invention.

As a second alternative mode, as shown in FIGS. 14 to 16 of the drawings, each of the displaying grids has a transparent zone and an opaque zone wherein light is incapable of passing through the opaque zone. Accordingly, the total area of the transparent zone should be equal to or less than the total area of the displaying zone.

As an illustrating shown in FIG. 14, the transparent zone is positioned at a central portion of a particular displaying grid, having a rectangular transparent zone with a length of about 60% of the length of that displaying grid, and a width of about 40% of the width of that displaying grid. Alternatively, the transparent zone can be located at an upper and a lower portion of the displaying grid, depending on the actual situation and the preference of the advertisement's host.

The advantage of utilizing opaque zone is elaborated as follows: since practically in between the filtering grids and the canvas there should be a very small gap that allows light to pass therethrough. Moreover, the shapes and the areas of the filtering grids are arranged to be equal to the canvas pixels respectively, therefore, the quality of the image as displayed by the displaying method of the present invention may be deteriorated due to the these two reasons. The purpose of employing opaque zone is to prevent leaking of light at the side edges of each of the pixels. As an illustration, the area of the transparent zone in a particular displaying grid should be in the range of 20%–80% of the area of that displaying grid.

What is claimed is:

1. A method of displaying multiple images, comprising the steps of:

(a) providing a plurality of raw images;

(b) extracting a utility image zone for each of said raw images, and diving said utility image zone of each of said raw images into a plurality of image pixels;

(c) for each of said image pixels of each of said utility image zones, establishing a plurality of pixel arrays arranged to distribute in a predetermined orientation;

(d) providing a raw canvas, diving said canvas into a plurality of canvas pixels, and for each of said canvas pixels, establishing a plurality of canvas pixel matrixes arranged with respect to said predetermined orientation of said pixel arrays;

(e) adjusting sizes of said image pixels of said utility image zones equal to sizes of said canvas pixels of said raw canvas respectively;

(f) superimposing said image pixel arrays onto said canvas pixel arrays respectively in a predetermined order to form a multiple image canvas, wherein said image pixels and said canvas pixels are square in shape having a predetermined and substantially equal area, wherein said image pixel arrays and said canvas pixel arrays are substantially oriented at 45 degrees with respect to horizontal;

(g) providing a plurality of filtering grids, comprising a displaying grid and a blocking grid, positioned and supported on top on said multiple image canvas in such a manner that said filtering grids are capable of sliding along said multiple image canvas so as to selectively block and display said image pixels, wherein said displaying grids are distributed in such a manner that each of said two displaying grids have an interval of multiple of a length of one of said canvas pixels, wherein said multiples are defined as a total number of said raw images minus one, wherein at least one of said blocking grids are provided between each two of said displaying grids; and (h) providing illumination to said multiple image canvas.

2. The displaying method, as recited in claim 1, wherein in said step (g), each of said filtering grids is arranged to slidably moved along said multiple images canvas in an interval of one canvas pixel so as to selectively and consecutively display said pixels arrays of said raw images respectively.

3. The displaying method, as recited in claim 2, wherein after said step (f) and before said step (g), said displaying method further comprises a step of implementing a pixel graphics of said multiple images canvas onto a printing medium.

4. The displaying method, as recited in claim 3, wherein in said step (g), a plurality of sealing grid rows are extended from two outer sides of said outermost filtering grids for blocking light leaking from said edges portions of said outermost filtering grids.

5. A method of displaying multiple images, comprising the steps of:

(a) providing a plurality of raw images;

(b) extracting a utility image zone for each of said raw images, and diving said utility image zone of each of said raw images into a plurality of image pixels;

(c) for each of said image pixels of each of said utility image zones, establishing a plurality of pixel arrays arranged to distribute in a predetermined orientation;

(d) providing a raw canvas, diving said canvas into a plurality of canvas pixels, and for each of said canvas pixels, establishing a plurality of canvas pixel matrixes arranged with respect to said predetermined orientation of said pixel arrays;

(e) adjusting sizes of said image pixels of said utility image zones equal to sizes of said canvas pixels of said raw canvas respectively;

(f) superimposing said image pixel arrays onto said canvas pixel arrays respectively in a predetermined order to form a multiple image canvas;

(g) providing a plurality of filtering grids, comprising a displaying grid and a blocking grid, positioned and supported on top on said multiple image canvas in such a manner that said filtering grids are capable of sliding along said multiple image canvas so as to selectively block and display said image pixels, wherein each of said filtering grids is arranged to slidably moved along said multiple images canvas in an interval of one canvas pixel so as to selectively and consecutively display said pixels arrays of said raw images respectively; and (h) providing illumination to said multiple image canvas.

6. The displaying method, as recited in claim 5, wherein after said step (f) and before said step (g), said displaying method further comprises a step of implementing a pixel graphics of said multiple images canvas onto a printing medium.

7. The displaying method, as recited in claim 6, wherein in said step (g), a plurality of sealing grid rows are extended from two outer sides of said outermost filtering grids for blocking light leaking from said edges portions of said outermost filtering grid.

8. A method of displaying multiple images, comprising the steps of:

(a) providing a plurality of raw images;

(b) extracting a utility image zone for each of said raw images, and diving said utility image zone of each of said raw images into a plurality of image pixels;

(c) for each of said image pixels of each of said utility image zones, establishing a plurality of pixel arrays arranged to distribute in a predetermined orientation;

(d) providing a raw canvas, diving said canvas into a plurality of canvas pixels, and for each of said canvas pixels, establishing a plurality of canvas pixel matrixes arranged with respect to said predetermined orientation of said pixel arrays;

(e) adjusting sizes of said image pixels of said utility image zones equal to sizes of said canvas pixels of said raw canvas respectively;

(f) superimposing said image pixel arrays onto said canvas pixel arrays respectively in a predetermined order to form a multiple image canvas, wherein said image pixels and said canvas pixels are square in shape having a predetermined and substantially equal area, wherein said image pixel arrays and said canvas pixel arrays are substantially oriented at 45 degrees with respect to horizontal;

(g) providing a plurality of filtering grids, comprising a displaying grid and a blocking grid, positioned and supported on top on said multiple image canvas in such a manner that said filtering grids are capable of sliding along said multiple image canvas so as to selectively block and display said image pixels, wherein each of said filtering grids is arranged to slidably moved along said multiple images canvas in an interval of one canvas pixel so as to selectively and consecutively display said pixel arrays of said raw images respectively; and (h) providing illumination to said multiple image canvas.

9. The displaying method, as recited in claim 8, wherein after said step (f) and before said step (g), said displaying method further comprises a step of implementing a pixel graphics of said multiple images canvas onto a printing medium.

10. The displaying method, as recited in claim 9, wherein in said step (g), a plurality of sealing grid rows are extended from two outer sides of said outermost filtering grids for blocking light leaking from said edges portions of said outermost filtering grids.

11. A method of displaying multiple images, comprising the steps of:

(a) providing a plurality of raw images;

(b) extracting a utility image zone for each of said raw images, and diving said utility image zone of each of said raw images into a plurality of image pixels;

(c) for each of said image pixels of each of said utility image zones, establishing a plurality of pixel arrays arranged to distribute in a predetermined orientation;

(d) providing a raw canvas, diving said canvas into a plurality of canvas pixels, and for each of said canvas pixels, establishing a plurality of canvas pixel matrixes arranged with respect to said predetermined orientation of said pixel arrays;

(e) adjusting sizes of said image pixels of said utility image tones equal to sizes of said canvas pixels of said raw canvas respectively;

(f) superimposing said image pixel arrays onto said canvas pixel arrays respectively in a predetermined order to form a multiple image canvas;

(g) providing a plurality of filtering grids, comprising a displaying grid and a blocking grid, positioned and supported on top on said multiple image canvas in such a manner that said filtering grids are capable of sliding along said multiple image canvas so as to selectively block and display said image pixels, wherein a plurality of sealing grid rows are extended from two outer sides of said outermost filtering grids for blocking light leaking from said edges portions of said outermost filtering grid; and (h) providing illumination to said multiple image canvas.

12. A method of displaying multiple images, comprising the steps of:

(a) providing a plurality of raw images;

(b) extracting a utility image zone for each of said raw images, and diving said utility image zone of each of said raw images into a plurality of image pixels;

(c) for each of said image pixels of each of said utility image zones, establishing a plurality of pixel arrays arranged to distribute in a predetermined orientation;

(d) providing a raw canvas, diving said canvas into a plurality of canvas pixels, and for each of said canvas pixels, establishing a plurality of canvas pixel matrixes arranged with respect to said predetermined orientation of said pixel arrays;

(e) adjusting sizes of said image pixels of said utility image zones equal to sizes of said canvas pixels of said raw canvas respectively;

(f) superimposing said image pixel arrays onto said canvas pixel arrays respectively in a predetermined order to form a multiple image canvas, wherein said image pixels and said canvas pixels are square in shape having a predetermined and substantially equal area, wherein said image pixel arrays and said canvas pixel arrays are substantially oriented at 45 degrees with respect to horizontal;

(g) providing a plurality of filtering grids, comprising a displaying grid and a blocking grid, positioned and supported on top on said multiple image canvas in such a manner that said filtering grids are capable of sliding along said multiple image canvas so as to selectively block and display said image pixels, wherein a plurality of sealing grid rows are extended from two outer sides of said outermost filtering grids for blocking light leaking from said edges portions of said outermost filtering grid; and (h) providing illumination to said multiple image canvas.

* * * * *